US008151831B2

(12) United States Patent
Zanini et al.

(10) Patent No.: US 8,151,831 B2
(45) Date of Patent: Apr. 10, 2012

(54) CAROUSEL FOR PROCESSING CONTAINERS FILLED WITH LIQUID OR POWDER PRODUCTS

(75) Inventors: Gianpietro Zanini, Montanara di Curtatone (IT); Marco Baroni, Barbasso di Roncoferraro (IT)

(73) Assignee: Azionaria Costruzioni Macchine Automatiche A.C.M.A. S.p.A. (IT)

( * ) Notice: Subject to any disclaimer, the term of this patent is extended or adjusted under 35 U.S.C. 154(b) by 904 days.

(21) Appl. No.: 12/223,193

(22) PCT Filed: Feb. 12, 2007

(86) PCT No.: PCT/IB2007/000319

§ 371 (c)(1),
(2), (4) Date: Jul. 24, 2008

(87) PCT Pub. No.: WO2007/093872

PCT Pub. Date: Aug. 23, 2007

(65) Prior Publication Data

US 2010/0224283 A1 Sep. 9, 2010

(30) Foreign Application Priority Data

Feb. 14, 2006 (IT) ..... BO2006A0107

(51) Int. Cl.
*B65B 1/30* (2006.01)

(52) U.S. Cl. ..... 141/83; 141/152; 141/94; 141/145; 141/144; 141/146; 141/147; 53/276; 53/284.6

(58) Field of Classification Search ..... 141/83, 141/144–152; 53/272, 276, 278, 284.5, 284.6
See application file for complete search history.

(56) References Cited

U.S. PATENT DOCUMENTS

| | | | | | |
|---|---|---|---|---|---|
| 1,182,142 | A | * | 5/1916 | Calleson | 53/276 |
| 1,938,821 | A | * | 12/1933 | Fenn | 426/394 |
| 1,965,246 | A | * | 7/1934 | Meyer | 141/39 |
| 2,122,150 | A | * | 6/1938 | Lippold | 141/152 |
| 2,315,255 | A | * | 3/1943 | Giles et al. | 141/147 |
| 2,372,899 | A | * | 4/1945 | Kantor | 141/105 |
| 2,597,791 | A | * | 5/1952 | Graham-Enock | 53/279 |
| 2,756,916 | A | * | 7/1956 | Kerr | 141/146 |
| 2,762,545 | A | * | 9/1956 | Breeback | 141/1 |
| 3,116,766 | A | * | 1/1964 | Lohse et al. | 141/161 |
| 3,172,434 | A | * | 3/1965 | Boucher | 141/59 |
| 3,386,480 | A | * | 6/1968 | Riesenberg | 141/147 |
| 3,580,302 | A | * | 5/1971 | Riesenberg | 141/141 |

(Continued)

FOREIGN PATENT DOCUMENTS

EP 1 251 085 A1 10/2002

(Continued)

*Primary Examiner* — Gregory Huson
*Assistant Examiner* — Ted Kalbach, Jr.
(74) *Attorney, Agent, or Firm* — Timothy J. Klima; Shuttleworth & Ingersoll, PLC

(57) ABSTRACT

Containers for packaging liquid or powder products are directed onto a carousel (1) presenting a support element (9) equipped with a number of peripheral stations (10), each accommodating a relative container (2), and set in rotation about a vertical axis (X) by a drive system (6) housed internally of floor-standing frame (5) on which the carousel (1) is mounted. The support element (9) presents substantially disc-like appearance and is hollow, composed of a top panel (11) and a bottom panel (12) distanced one from another in such a way as to create an annular chamber (13) between the two panels.

18 Claims, 5 Drawing Sheets

U.S. PATENT DOCUMENTS

| | | | | |
|---|---|---|---|---|
| 3,628,698 | A * | 12/1971 | Allen et al. | 222/168 |
| 3,841,363 | A * | 10/1974 | Stigler | 141/142 |
| 3,986,320 | A * | 10/1976 | Bausch et al. | 53/505 |
| 4,053,003 | A * | 10/1977 | Ferrero et al. | 141/144 |
| 4,326,568 | A * | 4/1982 | Burton et al. | 141/114 |
| 4,371,014 | A * | 2/1983 | Cane | 141/91 |
| 4,582,102 | A * | 4/1986 | Risser | 141/95 |
| 4,949,766 | A * | 8/1990 | Coatsworth | 141/67 |
| 5,337,796 | A * | 8/1994 | Ohmori et al. | 141/168 |
| 6,058,985 | A * | 5/2000 | Petri et al. | 141/168 |
| 6,341,472 | B1 * | 1/2002 | Schroeder | 53/426 |
| 6,644,363 | B2 * | 11/2003 | Sogliani et al. | 141/83 |
| 6,810,927 | B2 * | 11/2004 | Ronchi | 141/146 |
| 7,013,624 | B2 * | 3/2006 | Zwilling | 53/544 |
| 7,062,894 | B2 * | 6/2006 | Loffler | 53/585 |
| 7,114,535 | B2 * | 10/2006 | Hartness et al. | 141/145 |
| 7,165,582 | B2 * | 1/2007 | Till | 141/89 |
| 7,299,832 | B2 * | 11/2007 | Hartness et al. | 141/144 |
| 7,328,558 | B2 * | 2/2008 | Zwilling | 53/544 |
| 7,513,279 | B2 * | 4/2009 | Bernhard et al. | 141/90 |
| 7,681,606 | B2 * | 3/2010 | Khan et al. | 141/147 |
| 7,837,026 | B2 * | 11/2010 | Zanini et al. | 198/478.1 |
| 2005/0016624 | A1 * | 1/2005 | Till | 141/144 |
| 2005/0045244 | A1 * | 3/2005 | Hartness et al. | 141/144 |
| 2006/0081305 | A1 * | 4/2006 | Monti | 141/144 |
| 2007/0029002 | A1 * | 2/2007 | Bernhard et al. | 141/144 |
| 2007/0193652 | A1 * | 8/2007 | Till et al. | 141/144 |
| 2009/0133777 | A1 * | 5/2009 | De Antoni Migliorati | 141/145 |
| 2009/0159152 | A1 * | 6/2009 | Till | 141/145 |
| 2009/0223168 | A1 * | 9/2009 | Zanini et al. | 53/281 |
| 2010/0083613 | A1 * | 4/2010 | Krulitsch | 53/276 |
| 2010/0101183 | A1 * | 4/2010 | Beisel | 53/276 |
| 2010/0175784 | A1 * | 7/2010 | Zanini | 141/283 |
| 2010/0282523 | A1 * | 11/2010 | Zanini et al. | 177/245 |
| 2010/0317280 | A1 * | 12/2010 | Detemple | 454/187 |
| 2011/0108161 | A1 * | 5/2011 | Graffin | 141/83 |

FOREIGN PATENT DOCUMENTS

| | | |
|---|---|---|
| EP | 1 514 834 A | 3/2005 |

* cited by examiner

CAROUSEL FOR PROCESSING CONTAINERS FILLED WITH LIQUID OR POWDER PRODUCTS

This application is the National Phase of International Application PCT/IB2007/000319 filed Feb. 12, 2007 which designated the U.S. and that International Application was published under PCT Article 21(2) in English.

TECHNICAL FIELD

The present invention relates to a carousel for processing containers filled with liquid or powder products.

The invention finds application advantageously in the art field of carousel type equipment used for sterilizing, filling and closing containers in which a variety of different substances can be packaged, for example liquid food products such as milk or fruit juices, and non-food products such as mineral lubricating oils, detergents, etc.

BACKGROUND ART

Carousel equipment of conventional design comprises a bed consisting of a single unit preassembled at the premises of the constructor and presenting a plurality of bays serving to accommodate respective carousels on which the containers are processed, that is to say, for example, sterilized, filled with a selected product and closed with a cap. Also mounted to the bed are devices for transferring the containers from one carousel to the next, as well as infeed and outfeed devices with relative motors, or a single motor, by which the containers are conveyed into and directed away from the train of carousels.

The prior art also embraces equipment wherein each carousel is equipped with a respective base frame housing the devices by which the relative carousel is set in motion.

In greater detail, carousels of conventional type appear as a revolving plate carrying a plurality of peripheral pedestals on which to stand the containers. The plate presents a peripheral outline of generally circular appearance and is keyed onto a respective rotating shaft emerging from the base frame and connected suitably to the motion-inducing devices housed in the frame.

In the case of carousels on which containers are filled, the plate carries a plurality of weighing devices associated each with a respective pedestal. Such devices are able to monitor the weight of the container continuously during the filling step.

Mounted above the revolving plate is a dispensing plate, keyed likewise to the shaft and rotatable as one with the revolving plate. The dispensing plate carries a plurality of filler nozzles from which a liquid or powder product is batched into the containers placed on the weighing devices.

In particular, each nozzle is positioned on the peripheral edge of the dispensing plate, above a relative weighing device, its operation interlocked to the selfsame weighing device in such a way that the flow of the product will be shut off when the container reaches a predetermined weight.

Carousels of the prior art type described above present significant drawbacks.

The drawbacks in question concern the structure of the revolving plate, which is required to support the aforementioned weighing devices and tends in general as a result to be very heavy and bulky.

In effect, the plate is solid steel, of thickness sufficient to guarantee high structural rigidity.

Furthermore, the plate in question is subject to appreciable wobble and vibration that disturb the reading of the container weight. For this reason, the plates commonly utilized consist in a flat disc of considerably large proportions, capable of damping vibrations. Consequently, the carousel as a whole is rendered cumbersome and heavy, creating problems with transport and installation of the equipment.

In addition, cleaning operations carried out on the carousels involve the use of a washing liquid that falls and collects on the revolving plate. This same liquid lingers on the flat top of the plate, creating damp patches that can cause metal parts of the disc to rust. When the plate is set in rotation, moreover, the cleansing liquid is flung outwards, wetting the areas around the carousel.

The object of the present invention is to provide a carousel for processing containers filled with liquid or powder products, such as will be unaffected by the drawbacks mentioned above.

In particular, the object of the invention is to provide a carousel for processing containers filled with liquid or powder products, equipped with a revolving plate that is lightweight, and at the same time rigid, sturdy and stable.

A further object of the present invention is to provide a carousel for processing containers filled with liquid or powder products, such as will enable the removal of any liquids deposited on the selfsame carousel during the course of washing operations.

DISCLOSURE OF THE INVENTION

The stated object is realized, according to the present invention, in a carousel for processing containers filled with liquid or powder products, comprising a support element presenting a plurality of peripheral stations serving to accommodate respective containers for processing, and rotatable about a respective vertical axis; means by which motion is induced in the support element; and at least one floor-standing base frame on which the carousel is mounted and in which the motion-inducing means are housed, characterized in that the support element presents an annular chamber internally.

The invention will now be described in detail, by way of example, with the aid of the accompanying drawings, in which.

Figure 1:
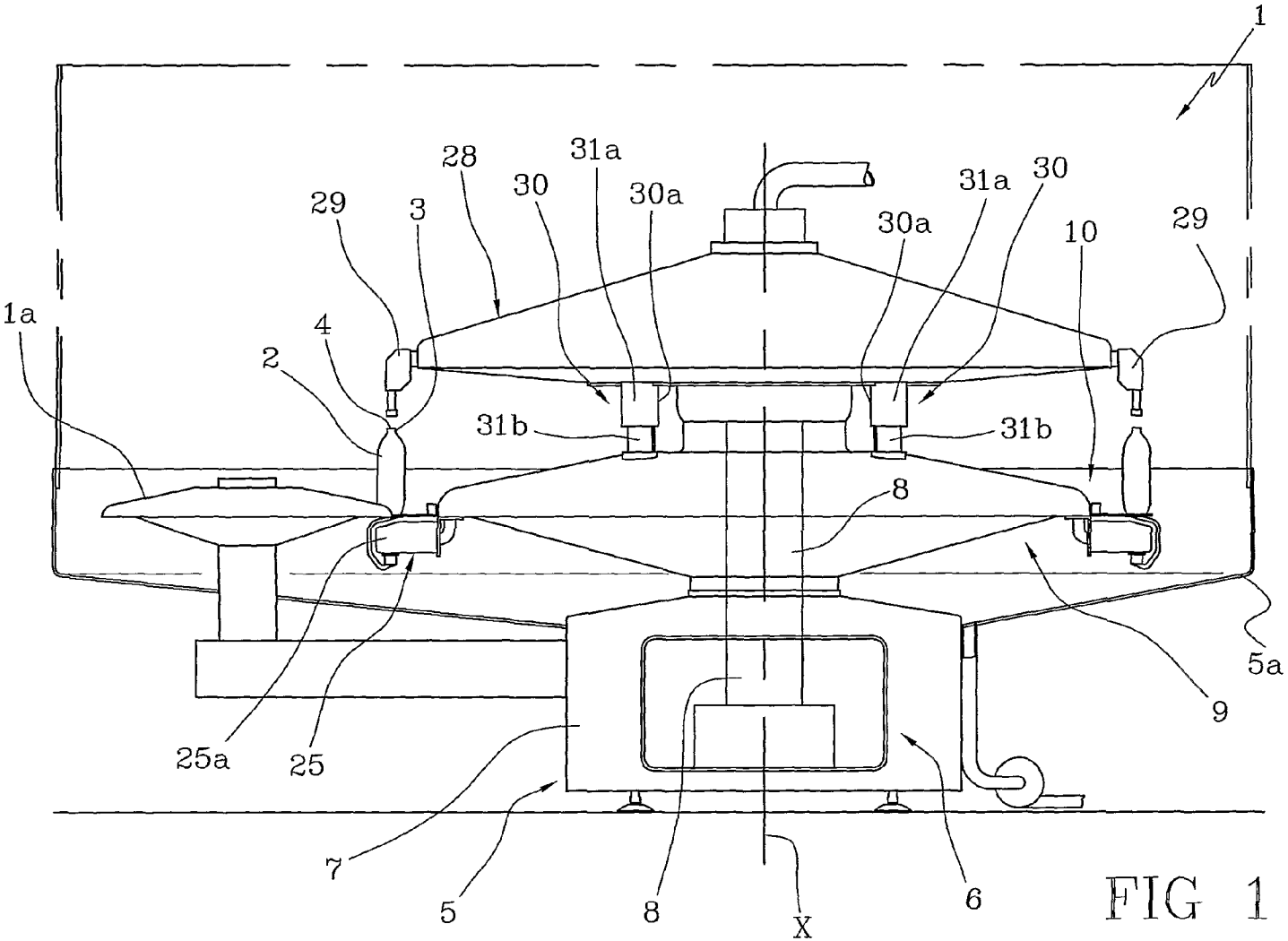
FIG. 1 shows a carousel for processing containers filled with liquid or powder products, according to the present invention, viewed in a side elevation and partly in section.
Figure 2:
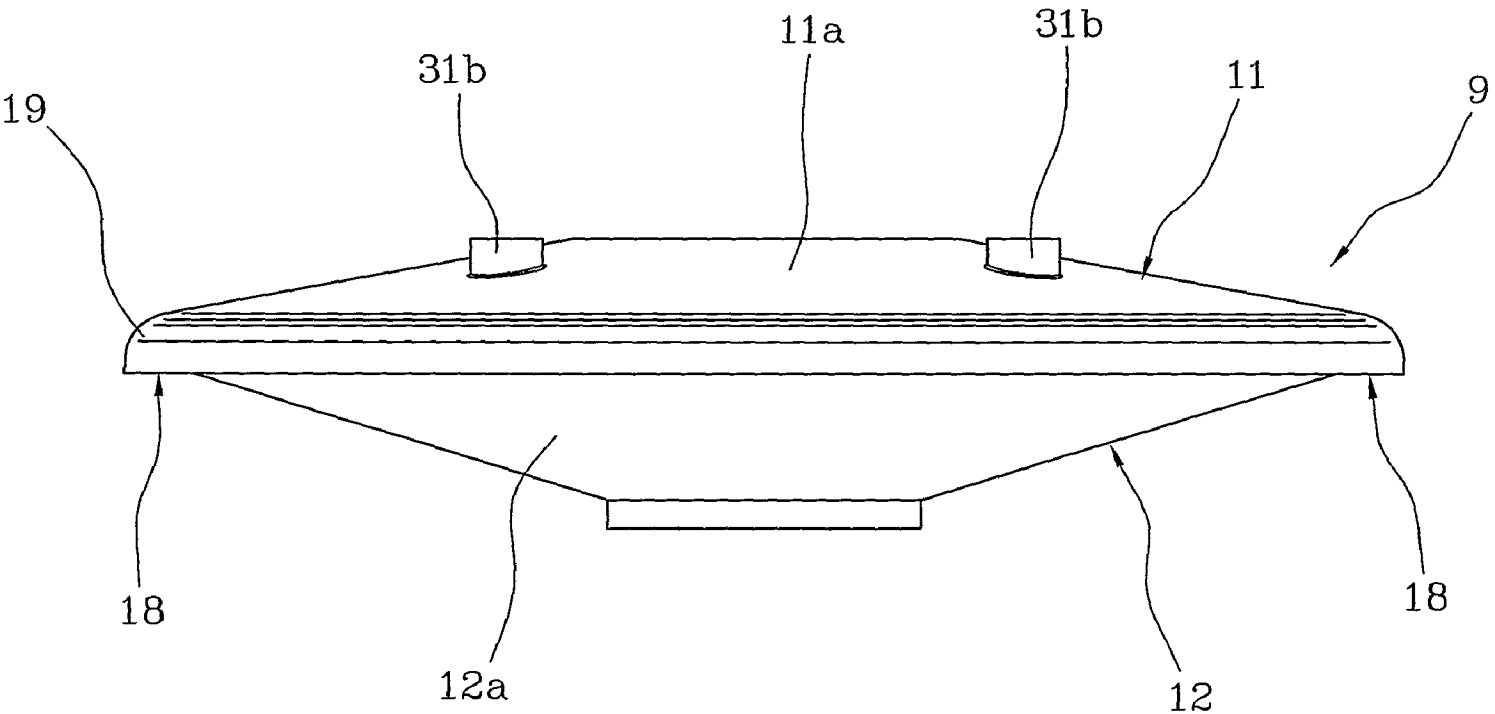
FIG. 2 is a constructional detail of the carousel in FIG. 1, viewed in a side elevation.

With reference to FIG. 1, numeral 1 denotes a carousel, considered in its entirety, for processing containers 2 filled with liquid or powder products, each presenting a neck 3 and a filler mouth 4 closed by fitting a cap.

In general, a carousel 1 of the type in question for processing containers 2, operated for example as a sterilizing, filling or capping unit, is furnished at least with a floor-standing base frame 5 that serves also to house motion-inducing means 6.

In the example of FIG. 1, the carousel 1 is used to fill the containers 2. Nonetheless, the feature to which the invention relates is applicable to any given carousel 1 utilized in equipment for processing containers 2 of the type in question, and accordingly, no limitation in scope is implied.

To advantage, the base frame 5 presents a hollow cylindrical body 7 and, extending upward from the body, a rotating shaft 8 that forms part of the motion-inducing means 6.

In particular, such motion-inducing means 6 consist in a motor (not illustrated in the drawings) coupled to the aforementioned shaft 8, which is disposed vertically and coincides with a respective vertical axis X of rotation.

In a preferred embodiment of the invention, the carousel 1 is equipped further with a tank 5*a* mounted to the base frame 5, substantially concave in shape and serving to collect any cleaning liquids that may be directed onto the carousel 1.

The carousel 1 also presents a support element 9 located above the tank 5*a* and affording a plurality of peripheral stations 10 in which to accommodate the containers 2.

More exactly, the support element 9 is keyed to the shaft 8 above the base frame 5, rotatable thus about the aforementioned vertical axis X, and presents a substantially disc-like form aligned concentrically on the selfsame axis X.

In greater detail, the support element 9 presents a top panel 11 and a bottom panel 12, distanced one from another so as to create an annular chamber 13. The two panels 11 and 12 are substantially of laminar construction, presenting respective convex outer surfaces 11*a* and 12*a* and concave inner surfaces 11*b* and 12*b*, the latter delimiting the aforementioned annular chamber 13.

Figure 3:
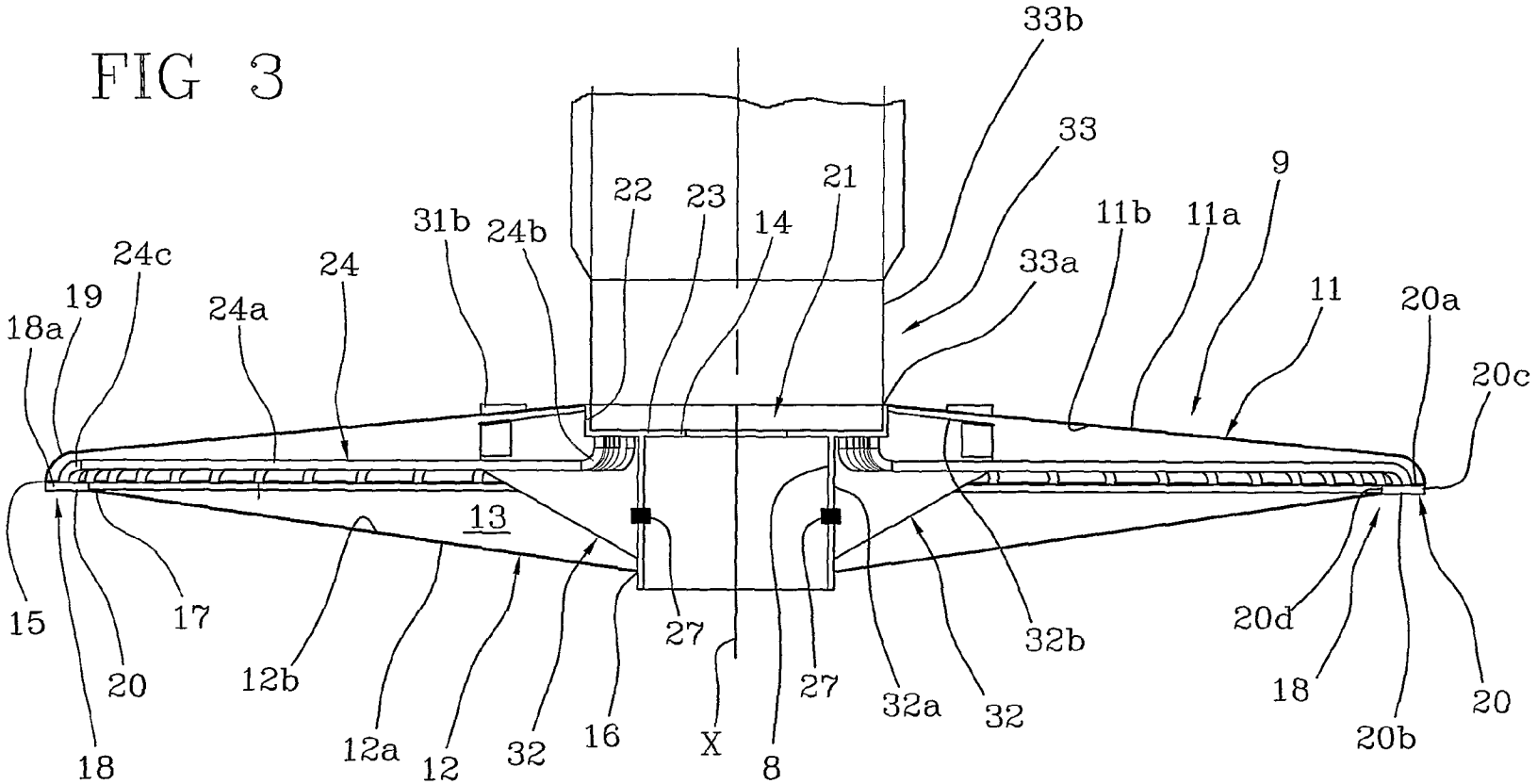
FIG. 3 shows the constructional detail of FIG. 2 viewed in a side elevation and in section.

As illustrated to advantage in FIG. 3, the top panel 11 also presents a circular inner edge 14 offered in fluid-tight contact to the shaft 8 and an outer or peripheral edge 15, likewise circular, remote from the inner edge 14. Similarly to the top panel 11, the bottom panel 12 presents a circular inner edge 16 offered in fluid-tight contact to the shaft 8 and a outer or peripheral edge 17, likewise circular, remote from the inner edge 16.

Still in FIG. 3, it will be seen that the inner edges 14 and 16 of the panels 11 and 12 are set apart one from the other and occupy parallel horizontal planes; conversely, the outer edges 15 and 17 occupy a common horizontal plane and are associated with an annular support 18 of which more will be said in due course.

Importantly, the top panel 11 is angled downward from the inner edge 14 toward the outer edge 15 so that any cleaning liquids deposited on the panel 11 will drain off unaided.

In addition, the top panel 11 presents a connecting portion 19 of curved sectional profile located at the respective outer edge 15.

The connecting portion 19 consists in a peripheral portion of the top panel 11, bent downward and presenting an edge that is one and the same as the aforementioned outer edge 15. Accordingly, any liquid falling on the outer surface 11*a* of the top panel 11 will run across the selfsame surface 11*a* and over the connecting portion 19, dropping ultimately below the support element 9. To advantage, the cleaning liquid is collected in the tank 5*a* beneath the element 9.

Likewise advantageously, the bottom panel 12 is angled downward from the respective outer edge 17 toward the inner edge 16.

With this arrangement, the support element 9 and the relative annular chamber 13 combine to present a substantially rhomboid appearance when viewed in cross section (FIG. 3).

The annular support 18 takes the form of an annular plate 20 presenting a flat top surface 20*a* disposed within a respective horizontal plane and, on the side opposite, a bottom surface 20*b* parallel to the top surface 20*a*. The top surface 20*a* is located internally of the annular chamber 13, facing the inner surface 11*b* of the top panel 11, whilst the bottom surface 20*b* is located externally of the chamber 13.

The annular plate 20 also presents a circular outer lip 20*c* associated with the outer edge 15 of the top panel 11, and a circular inner lip 20*d* associated with the outer edge 17 of the bottom panel 12.

In addition, the annular support 18 is furnished with a plurality of through holes 18*a* arranged around its entire circumferential length, each coinciding with a respective peripheral station 10.

The top panel 11 also presents a lowered portion 21 at the relative inner edge 14, establishing a blind cavity 21*a* of substantially circular shape.

More exactly, the lowered portion 21 coincides with a depression formed in a central part of the top panel 11, identifiable as a substantially annular vertical side wall 22 concentric with the vertical axis X aforementioned, and a bottom wall 23 disposed transversely to the side wall 22 and occupying a respective horizontal plane.

Figure 4:
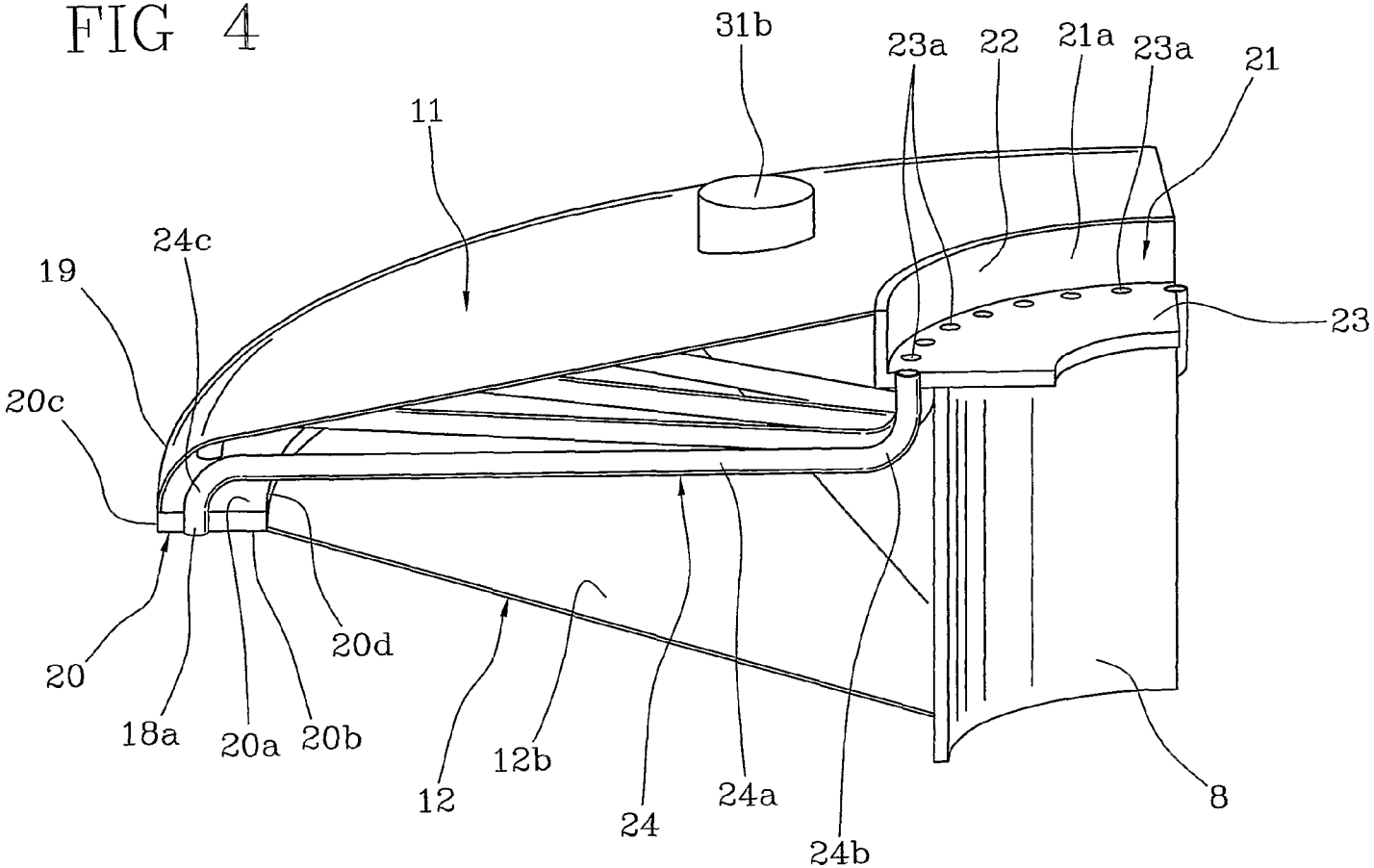
FIG. 4 shows the constructional detail of FIG. 2 viewed in perspective and in section.
Figure 5:
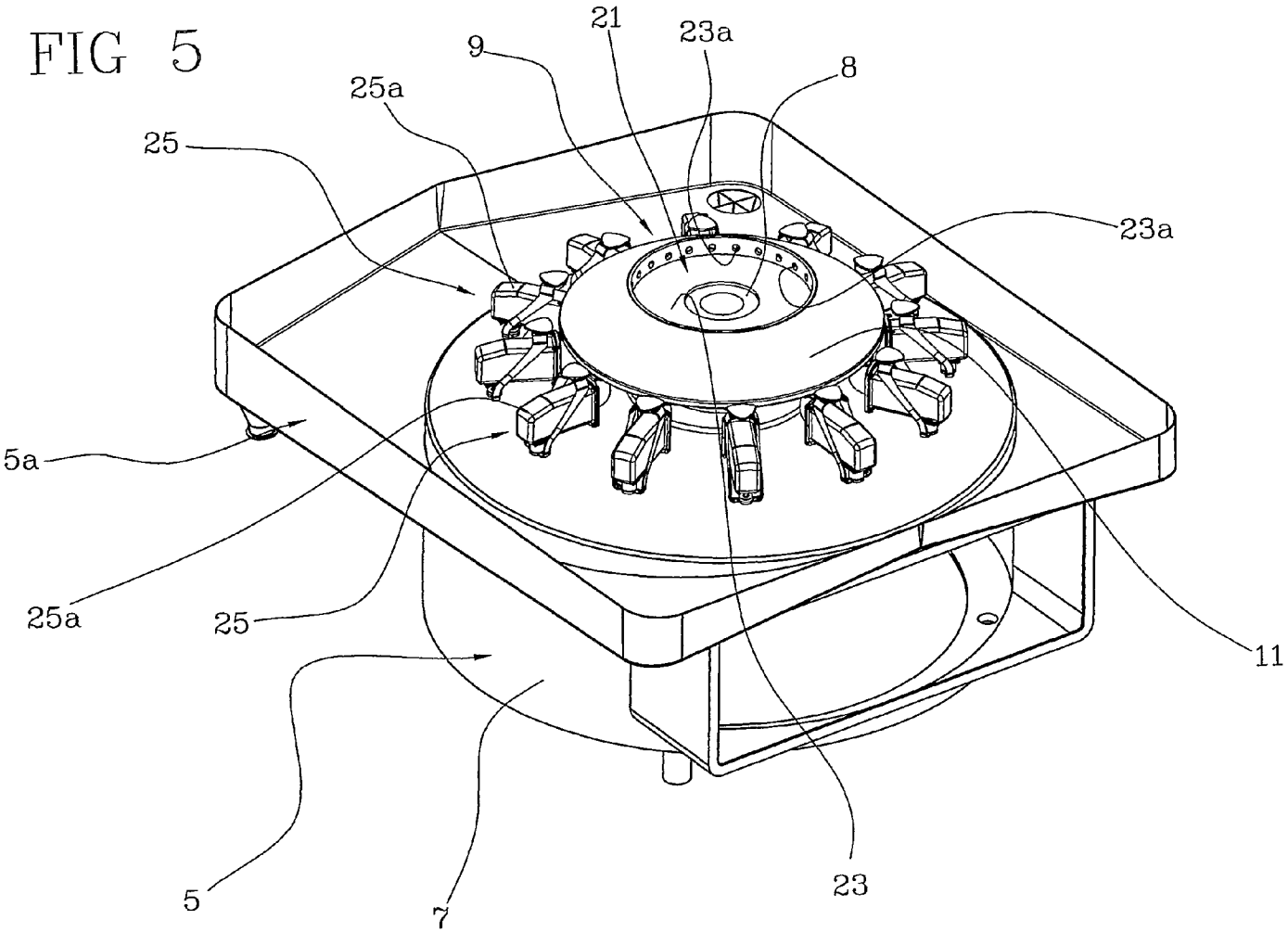
FIG. 5 shows a carousel for processing containers, viewed in perspective and with certain parts omitted better to illustrate others.

As illustrated to better effect in FIG. 4 and FIG. 5, the bottom wall 23 coincides with the inner edge 14 of the top panel 11 and presents a plurality of through holes 23*a* arranged around its entire circumferential length.

Preferably, as illustrated in FIG. 3, the support element 9 can be equipped with a casing portion 33 located above the lowered portion 21 and serving to cover the aforementioned cavity 21*a*.

In particular, the casing portion 33 consists in a substantially frustoconical top presenting a circular bottom end 33*a* fitted to the top surface 11*a* of the top panel 11, and a top end 33*b*, likewise circular, associated with the shaft 8. With this arrangement, the cavity 21*a* and part of the shaft 8 are covered by the casing portion 33.

The annular chamber 13 houses a plurality of communicating ducts 24 arranged radially around the entire angular expanse of the selfsame chamber 13. In particular, each communicating duct 24 presents a rigid tubular portion 24*a* extending longitudinally and in a substantially horizontal plane between a first end 24*b* and a second end 24*c*.

The first end 24*b* of the duct 24 is associated with a respective hole 23*a* in the bottom wall 23 of the lowered portion, and the second and 24*c* is associated with one of the holes 18*a* in the annular support 18.

To advantage, as discernible in FIG. 4, the first end 24*b* and second end 24*c* consist in respective radiused connecting segments of tube, or bends.

The support element 9 further comprises delivery means 27 serving to direct a gas into the annular chamber 13 at a pressure higher than the pressure externally of the selfsame chamber 13. Accordingly, any cleaning liquid that infiltrates the equipment can always be kept out of the chamber 13. Moreover, the pressure of the gas helps to increase the rigidity of the support element 9 as a whole.

The support element 9 also presents a plurality of pedestal components 25 on which to stand the single containers 2, associated with the bottom surface 20*b* of the annular plate 20 and projecting radially from the element 9.

In the example of FIG. 1 and FIG. 5, each pedestal component 25 takes the form of a weighing device 25*a*, conventional in embodiment and therefore not described in detail.

Each weighing device 25*a* is associated with the bottom surface 20*b* of the annular plate 20 at a point coinciding with a relative hole 18*a*, so as to allow the passage of an electrical connection component 26 through the selfsame hole 18*a*.

The electrical connection component 26 is routed along a respective communicating duct 24 and serves to connect the weighing device 25*a* with a processing logic unit neither illustrated nor described in detail.

Thus, the weight of the container 2 standing on the pedestal is monitored continuously by the weighing device 25*a*, a signal representing the weight is relayed to the processing unit, and the unit controls the level to which the container 2 is filled.

Also forming part of the carousel 1 is a rotary dispensing plate 28, positioned above the support element 9 and associated likewise with the shaft 8 in such a way that the plate 28 and the element 9 can be made to rotate about the vertical axis X as one.

Like the support element 9, the rotary plate 28 is disc-like and presents a substantially rhomboid cross section, so that cleaning liquid will run off into the aforementioned tank 5*a*.

The rotary dispensing plate 28 carries a plurality of filler nozzles 29 from which a liquid or powder product is delivered, each located above a relative weighing device 25*a* so as to fill a container 2 placed beneath.

The plate 28 is also capable of vertical movement toward and away from the support element 9 and thus adaptable to any type of container 2

More exactly, the carousel 1 is equipped with at least one linear actuator 30 projecting from the top panel 11 of the support element 9 and connected to the dispensing plate 28.

A preferred embodiment of the carousel 1, as shown in FIG. 1, will be equipped with a plurality of linear actuators 30, advantageously four, equispaced one from another and consisting each in a pneumatic or hydraulic cylinder 30*a*.

Each such cylinder 30*a* presents a first cylindrical end 31*a* associated with the underside of the dispensing plate 28, and a second cylindrical end 31*b* slidable relative to the first end 31*a* and housed at least partly in the annular chamber 13 (FIG. 3).

The second end 31*b* of the cylinder 30*a* is carried by a respective reinforcing bracket 32 of laminar construction, housed within the annular chamber 13 and occupying a plane normal to the surfaces of the top panel 11 and the bottom panel 12.

Each cylinder 30*a* is thus supported by a respective bracket 32, of which one side edge 32*a* is attached to the shaft 8.

Advantageously, each bracket 32 presents a substantially trapezoidal outline and is associated by way of a top edge 32*b*, disposed transversely to the side edge 32*a*, with the inner surface 11*b* of the top panel 11.

With an arrangement of this type, the brackets 32 and the ducts 24 combine to function as stiffening ribs giving greater rigidity to the support element 9 as a whole.

It will be observed that the structure of a support element 9 as described above might also be utilized for conveyor carousels 1*a* of the type illustrated schematically in FIG. 1.

The element 9 in question is especially lightweight by virtue of being hollow, a factor instrumental in overcoming problems associated with the transport and erection of one or more carousels 1 and 1*a* making up a system for processing containers 2.

In addition, given the pitched configuration of the top panel 11 and bottom panel 12, cleaning liquids falling on the support element 9 will run off into the tank 5*a* beneath, keeping the element 9 dry.

Finally, and importantly, the disc-like structure of the support element 9 affords notable stability, ensuring that there will be no unwanted vibrations transmitted to the weighing devices 25*a* when the carousel is set in rotation.

The invention claimed is:

1. A carousel for processing containers filled with liquid or powder products, comprising:

a support element having a plurality of peripheral stations serving to accommodate respective containers for processing, and rotatable about a respective vertical axis (X);

a motion inducing mechanism for inducing motion in the support element;

at least one floor-standing base frame on which the carousel is mounted, and in which the motion inducing mechanism is housed, the support element being of substantially disc-like appearance, comprising a top panel and a bottom panel set apart one from another so as to create an annular chamber internally of the support element, wherein the top panel and the bottom panel of the support element each have a circular inner edge, and a circular outer edge remote from the respective inner edge;

an annular support associated with the outer edges of the top panel and the bottom panel, the annular support including an annular plate having a flat top surface disposed within a respective horizontal plane and, on an opposite bottom surface parallel to the top surface, the top surface being located internally of the annular chamber and facing an inner surface of the top panel with the bottom surface being located externally of the annular chamber.

2. A carousel as in claim 1, wherein the motion inducing mechanism comprises a rotating shaft projecting upward from the base frame, aligned on the vertical axis (X) and engaged by the inner edge of each panel.

3. A carousel as in claim 1, wherein the top panel is angled downwardly from the inner edge toward the outer edge.

4. A carousel as in claim 1, wherein the bottom panel is angled downwardly from the outer edge toward the inner edge.

5. A carousel as in claim 1, wherein the support element and the annular chamber combine to present a cross section of substantially rhomboid appearance.

6. A carousel as in claim 1, wherein the top panel also includes a connecting portion of curved profile, merged with the outer edge, over which any liquids deposited on the top panel are caused to run off and drop toward the base frame beneath the support element.

7. A carousel as in claim 1, wherein the annular support also includes a circular outer lip oriented toward the outer edge of the top panel, and a circular inner lip on the opposite side of the plate to the outer lip, oriented toward the outer edge of the bottom panel.

8. A carousel as in claim 1, wherein the top panel of the support element further comprises a lowered portion, located at the relative inner edge and serving to establish a blind cavity of substantially circular shape, delimited by a vertical side wall extending around the periphery of the blind cavity, joined to a bottom wall disposed transversely to the side wall and occupying a respective horizontal plane.

9. A carousel as in claim 1, wherein the support element includes a delivery mechanism by which a gas is directed into the annular chamber at a pressure higher than a pressure externally of the annular chamber.

10. A carousel as in claim 8, further comprising at least one pedestal component associated with the bottom surface of the annular plate and aligned with a respective peripheral station, on which to stand a respective container.

11. A carousel as in claim 10, comprising a plurality of pedestal components associated circumferentially with the bottom surface of the annular plate, each having a device for weighing the respective container.

12. A carousel as in claim 11, further comprising a plurality of communicating ducts housed within the annular chamber, each having a first end associated with a respective through hole in the bottom wall of the lowered portion, and a second end associated with a hole in the annular support at a point coinciding with a respective peripheral station.

13. A carousel as in claim 12, wherein each communicating duct includes a rigid tubular portion extending longitudinally between the first end and the second end and occupying a radial position within the annular chamber, the first and second ends of each duct including respective connecting segments of tube by which the tubular portion is placed in fluid communication with the holes of the annular support and with the holes in the bottom wall of the lowered portion.

14. A carousel as in claim 12, wherein each weighing device comprises an electrical connection component passing along a respective duct, by way of which the weighing device is caused to communicate with a processing logic unit.

15. A carousel as in claim 11, comprising a rotary dispensing plate positioned above the support element, associated with a shaft and rotatable thus as one with the support element about the vertical axis (X), and having a plurality of filler nozzles from which a liquid or powder product is delivered, each located above a relative weighing device so as to fill a container with the product.

16. A carousel as in claim 15, comprising at least one linear actuator associated with the top panel of the support element and with the dispensing plate, by which the plate can be moved toward or away from the support element to adapt to the dimensions of the containers being filled.

17. A carousel as in claim 16 comprising a plurality of actuators, each having a pneumatic cylinder accommodated at least partly within the annular chamber and projecting from the top panel.

18. A carousel as in claim 17, wherein the support element further comprises a plurality of laminar reinforcing brackets housed in the annular chamber and occupying respective planes normal to the surfaces of the top panel and the bottom panel, each associated with the rotating shaft and with one of the pneumatic cylinders.

* * * * *